United States Patent [19]

Holden, Jr. et al.

[11] Patent Number: 4,891,480

[45] Date of Patent: Jan. 2, 1990

[54] APPARATUS INCLUDING ELECTRICAL CONTACTS

[75] Inventors: Clarence A. Holden, Jr., Morris Township, Morris County; Henry H. Law, Berkeley Heights, both of N.J.

[73] Assignee: American Telephone and Telegraph Company, AT&T Bell Laboratories, Murray Hill, N.J.

[21] Appl. No.: 305,212

[22] Filed: Feb. 1, 1989

[51] Int. Cl.[4] ..... H01H 1/02

[52] U.S. Cl. ..... 200/262; 200/269

[58] Field of Search ..... 200/262, 265, 266, 268, 200/269

[56] References Cited

U.S. PATENT DOCUMENTS 4,430,635 2/1984 Sacchetti ..... 200/269 X 4,503,131 3/1985 Baudrand ..... 200/269 X

*Primary Examiner*—Renee S. Luebke

*Attorney, Agent, or Firm*—Ronald G. Ort; Walter G. Nilsen

[57] ABSTRACT

An electrical device is provided which has contacts having regions with a conductive matte-finish metal surface. The matte-finish surface is characterized by having a Knoop hardness number of at least 300, a diffuse reflectance of less than about 20 percent, and a specular reflectance of less than about 2 percent. These contacts have a contact resistance of less than about 50 milliohms, under a 50-gram load, even after exposure to 50° C. and 95% relative humidity for a period of 20 days. Reflection electron microscopy shows that particularly advantageous matte-finish surfaces have sharply peaked asperities with average peak angles of less than about 90 degrees. In one embodiment, the surface is formed of hardened nickel electroplated from an electrolytic bath with a pH above about 7.0.

16 Claims, 2 Drawing Sheets

APPARATUS INCLUDING ELECTRICAL CONTACTS

TECHNICAL FIELD

This invention relates to electrical devices, and particularly to such devices having high-performance electrical contacts.

BACKGROUND OF THE INVENTION

Many electrical devices require high-performance contacts in which contact resistance should be low. Such contacts are used extensively in plugs, pins, relays, integrated circuit connectors, and the like. A typical specification for contacts used in connectors for electronic equipment includes a requirement for a contact resistance of less than 50 milliohms (mΩ). In addition, the contact should be resistant to atmospheric corrosion, and should be able to maintain its properties through a large number of operating cycles.

One common type of connector used on removable integrated circuit boards and the like is the "wiping connector", in which two contact surfaces "wipe" against each other as the connection is made. Such wiping contacts are generally located on the edges of the boards, and at least partially clean themselves when the board is inserted into a corresponding receptacle. Another type of connector is the "zero insertion force" (ZIF) connector, in which a first contact surface moves normal to a second surface to make contact without any wiping action. This type of connector can be located anywhere on the surface of an integrated circuit board, and thus offers greater flexibility in circuit design.

Precious metals, such as gold, platinum, and palladium have been found particularly suitable as contact materials because of their low contact resistance, chemical inertness, and reasonable abrasion resistance, particularly when alloyed with hardening additives. Contacts using precious metals often consist of a conductive substrate of a less expensive metal, such as copper or nickel-coated copper, on which the precious metal is applied to provide the contact surface. For example, one type of widely used gold electrode comprises a copper substrate, with a nickel intermediate layer, and a 25 microinch (0.6 μm) cobalt-hardened gold finish.

Beacust of the high cost of precious metals, the amount of such metals used in contact is an important consideration. Typically, a gold surface layer is at least 0.6 micrometers thick to ensure low porosity, low electrical resistance, and high wear resistance. Significant cost savings could be achieved by using a relatively inexpensive non-precious metal in place of some or all of the precious metal in contacts. However, non-precious metals have been found to be less reliable than the precious metals for precision contact surfaces. For example, although nickel has been used as a contact surface material in some types of devices, its susceptibility to oxidation, and the resulting increase in electrical resistance, has prevented its use on high performance contacts. (See "Properties of Electroplated Nickel Alloy Films for Contacts", by M. Robbins et al, *Plating and Surface Finishing,* March 1987, pages 56–59; "Stability of Electroplated Ni Films as a Function of the Electrolyte", by M. Robbins et al, *Extended Abstracts of the Electrochemical Society,* Fall Meeting 1987; and *Nickel and Chromium Plating,* by J. K. Dennis and T. E. Such, Butterworths, London, second ed., 1986, for detailed descriptions and characterizations of electrodeposited nickel films.) (See also U.S. Pat. No. 4,518,469, issued May 21, 1985 to Ng et al., for a method for electroplating an alloy of nickel and antimony from an acidic solution onto a contact substrate.)

In usual practice, steps are taken to ensure that the surface of a contact has a bright, shiny finish rather than a dull or matte finish. A bright finish is cosmetically more acceptable, and is also preferred because a dull finish generally indicates oxidation, porosity or other impurities or disruptions in the surface. However, Gamblin, U.S. Pat. No. 4,564,565, issued Jan. 14, 1986, relates to a method of making matte-finish electrical contact surfaces by the electrolytic deposition of nickel in crystalline form onto a substrate. The process involves deposition from a plating bath containing a nickel salt and a specific anion selected from the group of $TiF_6$, $ZrF_6$, $HfF_6$, and $TaF_7$.

The presence of contaminants on the surface of contacts is associated with greatly increased contact resistance of the connector, regardless of the conductivity of the underlying material. Although chemical inertness generally prevents the formation of oxides or other decomposition products on precious metal-coated surfaces, oxidation of non-precious metals, as previously discussed in the context of nickel, has been a problem. Such oxidation typically forms a strongly adherent insulating layer which increases contact resistance. In addition, the accumulation of loose airborne contaminants, such as hydrocarbons, salts, fine dusts, and the like, tends to increase the contact resistance of any contact. Although the wiping action of wiping contacts can generally remove loose surface contaminants, tightly adhered oxidation layers are not so easily removed. Furthermore, ZIF-type connectors need to be able to form low contact resistance. connections without any wiping action.

SUMMARY OF THE INVENTION

It is an object of the present invention to provide electrical devices with durable high performance contact having low contact resistance.

A further object of the invention is to provide such a contact formed with a non-precious metal surface.

In accordance with the present invention, electrical devices are provided with improved non-noble metal contacts that include a surface with a hard, matte-finish metal coating. For purposes of the present invention, the term "matte finish" is intended to mean a surface which is characterized by a diffuse reflectance of less than about 20 percent, accompanied by a specular reflectance of less than about 2 percent. For purposes of this invention, diffuse reflectance is defined as the 0-degree, 45 degree directional reflectance factor for amber light, as set forth in *ASTM Standards,* Designation E 97-82, incorporated herein by reference. Preferably, such matte surfaces are further characterized by having sharply peaked asperities, the peaks of which have average included angles of less than about 90 degrees. For abrasion resistance and durability over extended usage, the matte-finish metal surface also should be "hard", which for purposes of this invention, is defined as having a Knoop hardness number (HK) of at least 300. The contact of the present invention has a contact resistance of less than 50 milliohms, under a test load of 50 g, even after exposure to accelerated oxidation conditions of 50° C. and 95% relative humidity for a period of 20 days.

In one embodiment of the present invention, a hardened nickel composition is electrolytically applied to a metal contact substrate from an electrolytic bath with a pH in the range of about 7.0 to 8.5. Particularly good results are obtained with nickel/phosphorus and nickel/cobalt compositions, with nickel/phosphorus being quite advantageous. These materials form a matte-finish surface of the desired surface morphology, with a Knoop hardness number greater than 300, and a contact resistance less than 10 milliohms after oxidation testing.

BRIEF DESCRIPTION OF THE DRAWINGS

The present invention, as well as further objects and advantages thereof, will be apparent from the following description and the accompanying drawings in which.

DETAILED DESCRIPTION

Figure 1:
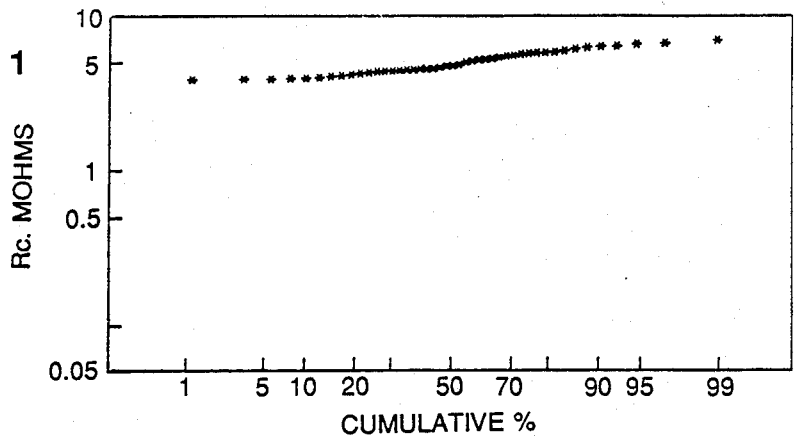
FIG. 1 is a graphical representation of the results of an accelerated oxidation test of an Ni/P-plated specimen, made in accordance with the present invention.

In accordance with the present invention, an electrical device is provided which has a contact with a region of a hard, matte-finish surface. Such surfaces provide low contact resistance and high wear and oxidation resistance.

For purposes of this invention, a "matte finish" is one which has a diffuse reflectance of less than about 20 percent and a specular reflectance of less than about 2 percent. As discussed above, diffuse reflectance is defined as the 0-degree, 45-degree directional reflectance factor for amber light. This is a measure of the amount of light which reflects from a surface at an angle of 45 degrees, from a beam directed perpendicularly to the surface. The light used for measuring should be in the visible wavelength range filtered through an amber filter. A low diffuse reflectance can result from either a dull, matte-finish surface, or from a mirror-like, highly reflective surface, which reflects light without scattering. Specular reflectance is a measure of the ratio of the radiance measured by reflectance to that measured directly. The specular reflectance criterion is provided to differentiate between matte-finish and mirror-like low diffuse reflectance surfaces.

Preferably, the matte surface includes regions of sharply peaked microscopic asperities. To be "sharply peaked", the asperities in such regions, on average, should have included peak angles of less than about 90°. The peak angles of these microscopic asperities can be measured by examination with reflection electron microscopy (REM). Reflection electron microscopy is a method of imaging the microscopic surface morphology of a specimen by directing an electron microscope beam across the surface at a very slight angle, referred to as the "glancing angle", typically less than about 2 degrees (0.03 radians). A photographic representation of the shape and size of the asperities is made by focussing and imaging the light which is reflected by their crystalline structure. (See Hsu, *J. Vacuum Science Technology B*, Vol. 3, No. 4, Jul/Aug 1985, pp 1035–6.) The peak angles of the imaged asperities are then measured to determine the average asperity angle.

In order for this matte-finish surface of microscopic asperities to withstand wear, it was found that the metal of the surface should have a Knoop hardness number (HK) of at least 300, as measured with a standard hardness tester using a Knoop indenter. Matte-finish surfaces which do not have this hardness wear smooth and thereby loose their desirable matte-finish characteristics. A detailed discussion of the standard test methods for measuring microhardness of electroplated coatings using a Knoop indenter is set forth in *ASTM Standards*, Designations B 578-87 and E 384-84, incorporated herein by reference. Essentially, in this test a diamond-shaped probe, under a given load, is projected into an electroplated surface to measure the hardness of the coating.

Contacts made in accordance with the present invention have a contact resistance of less than 50 milliohms, under a test load of 50 g, even after exposure to accelerated oxidation conditions of 50° C. and 95% relative humidity for a period of 20 days. In the examples discussed below, contact resistance ($R_c$) was measured in accordance with well-known test procedures, as set forth in *ASTM Standards*, Designations B 539-80 (1985) and B 667-80. Constant temperature and relative humidity were maintained by aqueous solutions in accordance with procedures set forth in *ASTM Standards*, Designation E 104.

An advantageous metal for use as the matte-finish surface is hardened nickel. Suitable hardening additives for nickel are well known, and include phosphorus and cobalt, as well as various organic materials such as coumarin. For a further discussion of hardening additives for nickel, see, for example, *The Properties of Electrodeposited Metals and Alloys*, W. H. Safranak, editor, AESF Society, 2nd ed., 1986.

A contemplated explanation of the tolerance of matte-finish nickel surfaces to oxidation is that the nickel oxide insulating film that forms is easily disrupted upon mechanical contact, due to the sharpness of the asperities. Local regions of high stress, developed when the asperities are in contact with other surfaces, are believed to create many small breaks in the oxide layer, thus providing for electrical contact.

In an advantageous embodiment of the present invention, a hardened nickel composition is electroplated onto a metal substrate from a plating bath containing a soluble source of nickel ions (preferably $Ni^{++}$), a source of a nickel-hardening additive (preferably phosphorus or cobalt), a complexing agent to keep the nickel in solution, and enough ammonium hydroxide ($NH_4OH$) to maintain the pH of the bath in the range of about 7.0 to 8.5. Good results are achieved using $NiCl_2$ as the source of nickel ion and ammonium chloride or ammonium citrate or both as complexing agents.

The concentration of the nickel ion in the plating bath should be high enough in relation to the current density so that the plating current is utilized to plate nickel, rather than dissociate water. The maximum nickel concentration is generally simply the solubility limit of the particular nickel compound being used. Good results are obtained using nickel supplied as $NiCl_2.6H_2O$, at a minimum concentration of about 30 g/l and a maximum of about 240 g/l.

A matte-finish coating with the desired surface characteristics is plated onto a metal substrate by maintaining a relatively neutral, slightly basic bath with a pH in the range of about 7.0 to 8.5, preferably between 7.7 and 8.3. When the pH of the bath falls below about 7.0, the nickel ion tends to precipitate out of solution. The pH is preferably maintained by the addition of ammonium hydroxide ($NH_4OH$), because ammonia does not accumulate in the bath as, for instance, the sodium of sodium hydroxide would. The pH of the bath is kept below about 8.5, preferably 8.3, to prevent excessive evaporation of ammonia. This is because at the normal operating temperatures of this process, ammonia tends to evolve rapidly at a pH above about 9.

Nickel ions undesirably tend to precipitate as $Ni(OH)_2$ at the operating conditions of the present plating bath. To keep the nickel ions in solution, complexing agents such as ammonium chloride ($NH_4Cl$) or ammonium citrate ($(NH_4)_2HC_6H_5O_7$) or both are preferably added to the bath. Excessive ammonium chloride will not significantly affect the plating bath, but should not be added in such an excessive amount that salting out occurs. Good results are obtained using up to about 150 g/l $NH_4Cl$, preferably between about 5 and 80 g/l. Ammonium citrate is useful as the complexing agent in place of some of the $NH_4Cl$. However, when citrate ions are in excess of the nickel ions, water tends to decompose preferentially over nickel ion reduction, thus reducing the current efficiency of the nickel plating. Other suitable complexing agents are acceptable, provided they do not bind the nickel ions so tightly that competing reactions reduce the plating efficiency.

Phosphorus is an advantageous hardening additive for use in combination with the nickel to achieve the desired minimum hardness of 300 HK. A suitable nickel/phosphorus coating should have at least about 0.01 atomic percent (a/o) phosphorus in order to obtain the desired hardness. Preferably, the cotaing should comprise about 0.1 to 0.5 a/o phosphorus. Using the present electrolytic coating method, it would be difficult to obtain Ni/P coatings with more than about 3 a/o phosphorus, but coatings with up to about 8 a/o phosphorus are acceptable. Above about 8 a/o phosphorus, the Ni/P becomes amorphous, and therefore not advantageous.

The Ni/P bath should advantageously include a soluble source of available phosphorus which combines with the nickel during electrodeposition. Good results are obtained using phosphorous acid ($H_3PO_3$) as the phosphorus source in the Ni/P coatings. A preferred range of about 5 to 80 g/l $H_3PO_3$ is used to obtain the desired level of P in the plating without adversely affecting the bath. Other suitable sources of phosphorus include the soluble phosphorous ion salts, as well as hypophosphorous ($PO_2$) compounds. However, phosphoric ($PO_4$) groups are believed to be too stable to supply P to the coating, and therefore are not recommended.

The above bath is used to electrolytically apply a nickel/phosphorus coating to a conductive metal substrate cathode. Good results are obtained using a current density to about 5 to 200 mA/cm$^2$. Within this range, the higher current densities tended to produce harder coatings. This increase in hardness is believed to be the result of an increased phosphorus content in Ni/P coatings applied at higher current densities. At current densities below 5 mA/cm$^2$, the plating rate is too slow to be practical. Current densities in excess of 200 mA/cm$^2$ tend to produce undesirable bright coatings.

When cobalt is used as the nickel-hardening additive, the cobalt should be supplied in a soluble and available form. Good results are obtained using $CoCl_2.6H_2O$ as the cobalt source, but other suitable cobalt sources will be apparent to one skilled in the art.

Moderate agitation of the bath promotes the desired matte finish, with too little or too much agitation tending to produce an unacceptable bright finish. The proper amount of agitation for a particular bath composition and current density is readily ascertainable by employing a control sample. A suitable temperature range for the plating bath is from about 35° to 70° C. As discussed in the examples below, a bath temperature below about 35° C. was found to produce coatings which did poorly in accelerated aging tests, and above about 70° C. it was inconvenient to maintain the ammonia concentration in the bath. The bath temperature is typically maintained in the range of about 40° to 65° C.

In a further embodiment of the present invention, a layer of gold is applied on top of the matte-finish conductive surface. A thin flash of gold of a minimum of about 1 to 5 microinches (0.025–0.13 μm) thick acts as a lubricant for wiping contacts and improves wear resistance, with particularly good results using a coating 5 to 10 microinches (0.13–0.25 μm) thick. A gold layer greater than about 10 microinches (0.25 μm) thick also provides a protective, bright coating to the contact surface. Because of the good wear and oxidation resistance properties of the matte-finishes of the present invention, excellent results can be obtained with gold coatings less than 25 microinches (0.6 μm) thick. When a gold coating is applied to the present matte-finish surface, the asperities are believed to act to hold the gold coating in place during operational wear cycles.

EXAMPLE I

Ni/P and Ni/Co contact coatings were electrolytically plated from slightly basic (pH between about 7.5 and 8.0) ammoniacal baths onto a copper substrate. The plating baths included nickel chloride as a nickel source, phosphorous acid for phosphorus, cobalt chloride for cobalt, ammonium citrate and/or ammonium chloride as complexing agents, and ammonium hydroxide to maintain pH. Table 1 shows the makeup of four experimental baths:

TABLE 1

| | Bath Compositions | | | |
|---|---|---|---|---|
| | Amount (g/l) | | | |
| Compound | Bath #1 | Bath #2 | Bath #3 | Bath #4 |
| $NiCl_2.6H_2O$ | 60 | 120 | 120 | 114 |
| $H_3PO_3$ | 20 | 20 | 20 | 0 |
| $(NH_4)_2HC_6H_5O_7$ | 40 | 40 | 0 | 0 |
| $NH_4Cl$ | 15 | 15 | 80 | 40 |
| $CoCl_2.6H_2O$ | 0 | 0 | 0 | 6 |

Temperatures of 45°–55° C., and current densities of 25–100 mA/cm$^2$ were the typical conditions set for producing Ni/P and Ni/Co deposits in accordance with the present invention. A typical Ni/P coating produced from Bath #2 was approximately 0.3 a/o phosphorus, as measured by Auger electron spectroscopy (AES) analysis. In preparing the bath solutions, it was found desirable to add the approximate amount of ammonium hydroxide quickly and with strong stirring, because of the tendency of nickel to precipitate out of solution, as $Ni(OH)_2$, in the pH range of 6–7.

The diffuse reflectance, specular reflectance, and hardness were measured on samples prepared by plating a copper substrate in each of the above baths. In addition, a comparative sample was prepared by electroplating a copper substrate with a matte finish from a standard $NiCl_2$ Watts nickel bath, without any hardening additives. Diffuse reflectance was measured with a Photovolt Model 577 reflection meter with a "T" search unit, using an amber filter which provided a peak wavelength of 600 nm. The meter was calibrated at zero reflectance, with a reflectance standard of about 20% before any measurement was made. Results are expressed as percent reflectance (R %). Specular reflectance was measured with the same reflection meter, but with an "M" search unit. All of the samples had specular reflectances well below 2 percent.

Hardness was measured using a standard hardness tester with a Knoop indenter, as discussed above. For the following tests, a 50 g load was used on the hardness probe, and the results are expressed as Knoop hardness number (HK). The diffuse reflectance and hardness results are shown in Table 2.

TABLE 2

| Bath No. | Diff. Refl. R % | Hardness HK |
|---|---|---|
| 1 | 13 | 380 |
| 2 | 9 | 330 |
| 3 | 10 | 360 |
| 4 | 8 | 400 |
| Watts | 24 | 250 |

The average asperity angle was measured by reflection electron microscopy (REM), using a Philips 400 electron microscope operated at 120 kV. For REM measurements, specimens were cut into planar dimensions of 3×1 mm. These specimens were then mounted on the single-tilt holder of the electron microscope in such a way that an incident electron beam hit the surface at a glancing angle of about 0.01 radians. The electron beam was thus reflected by the asperities on the specimen surface, and then imaged onto a dark field. Thus, the REM images provided profiles of the surface morphologies, from which the included peak angles of individual asperities were measured. As a typical example of the present invention, the above Bath #3 sample was found to have an average included asperity angle of about 45 degrees. The Watts nickel sample had an average angle of about 90 degrees.

In the following tests, contact resistance was measured using a converted micro-hardness tester to control the probe, and a computer programmable X-Y stage to position the sample. $R_c$ was measured at a load of 50 grams, and the value reported is the geometric means of fifty measurements made in a prescribed grid pattern in 0.5 mm steps. A pure gold wire (0.5 mm diameter) was used as the probe. The contact resistance was measured with an auto-ranging microammeter (Keithley Model 580) on the dry circuit mode. This limited the maximum open circuit voltage to 20 mV in order to prevent electrical breakdown of any film that might be present on the test sample. A personal computer (AT&T Model 6300) was used for control and data acquisition.

EXAMPLE II

The effects of varying bath temperature were examined, using the composition of the above Bath #1. Table 3 shows the effect of plating bath temperature (Temp °C.) on the contact resistance ($R_c$), expressed in milliohms (mΩ) of samples which were aged by exposure to 50° C. and 95% relative humidity. The pH of the bath was maintained between 7.5 and 8.0, and the plating was applied at a current density of 25 mA/cm$^2$. Readings were taken at various points on the samples, and the lowest and highest readings are given in the table.

TABLE 3

Effect of Plating Temperature

| | $R_c$ (mΩ)* | | |
|---|---|---|---|
| Temp. °C. | 4.5 days | 8 days | 20 days |
| 20 | 3.5–5.7 | 7.5–13 | 85–400 |
| 30 | 1.9–2.5 | 32–48 | 65–220 |
| 35 | 2.0–3.2 | 2.7–4.2 | 3.8–7.0 |
| 40 | 1.4–2.5 | 1.9–3.2 | 4.2–6.6 |
| 55 | 1.2–1.6 | 1.2–2.1 | 3.9–5.8 |

*Measured after exposure at 50° C., 95% R.H.

Samples plated at bath temperatures of 30° C. and less had undesirably bright finishes, and the $R_c$ of the Ni/P deposit increased beyond 50 mΩ after 20 days exposure to 50° C. and 95% R.H. The test results also show increases in contact resistance by exposure to this environment for all of the specimens. But, for the specimens prepared from baths at 35° C. and higher, the contact resistance remained below 10 mΩ after 20 days of exposure.

EXAMPLE III

A test sample was prepared by plating a copper substrate using the composition of the above Bath #2 at a temperature of about 45° C., a pH of about 7.8, and a current density of about 25 A/ft$^2$ (27 mA/cm$^2$). The sample was exposed to test conditions of 50° C. and 95% R.H. for a period of 9 months. Contact resistance was measured at numerous points on the sample, and the results are set forth graphically in FIG. 1. This graph shows a cumulative probability distribution plot of the percentage of test points with a contact resistance ($R_c$) below a given level in milliohms. The results show a contact resistance of less than 10 milliohms at the 99th percentile.

EXAMPLE IV

Figure 2:
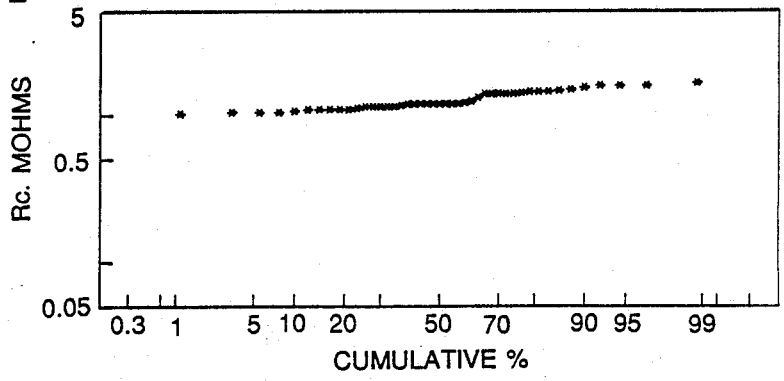
FIG. 2 depicts the results of an accelerated oxidation test on a gold-flashed Ni/P-plated specimen, made in accordance with the present invention.

A test specimen was prepared in the same manner as Example III, and was further coated with a 2.5 microinch (0.06 μm) flash of gold. This specimen was subjected to the well-known "Cleveland" accelerated environmental test for a period of 105 days. (See Bader et al, *Proc. of the Engineering Seminar on Electrical Contact Phenomena,* IEEE, 1978, p. 341, incorporated herein by reference.) The Cleveland test is considered a realistic accelerated oxidation test for contacts which are expected to operate in a typical urban industrial environment. Acceleration factors are roughly 20–25 when compared to an uncontrolled outdoor environment, and about 100 when compared to an air-conditioned indoor environment. That is, a 90-day test is considered the equivalent of 5 to 25 years of exposure to normal environmental conditions. FIG. 2 shows the cumulative probability plot for contact resistance measured at various points on the test specimen after a 105-day exposure period. The results show a contact resistance of less than 2 milliohms at the 99th percentile for the gold-flashed Ni/P sample.

EXAMPLE V

Figure 3:
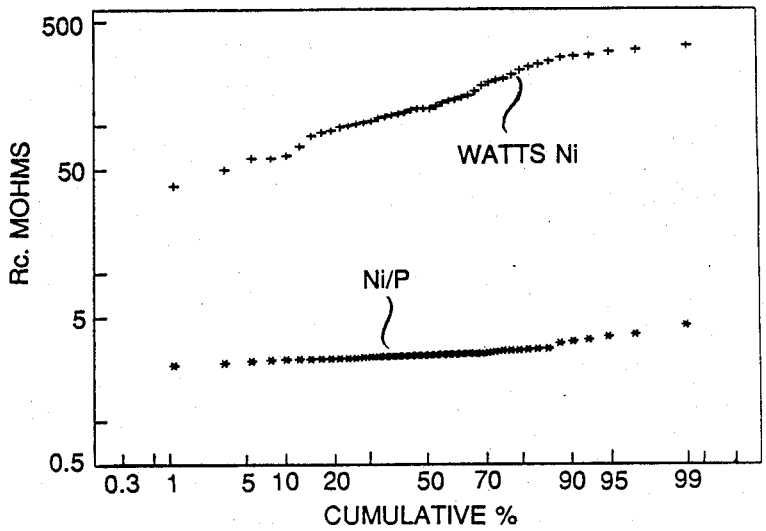
FIG. 3 depicts the results of accelerated oxidation tests on an Ni/P-plated specimen, made in accordance with the present invention, and a comparative sample plated from a Watts Ni bath.

An Ni/P test specimen was prepared by plating a copper substrate using the composition of the above Bath #3 at a temperature of about 55° C., a pH of about 7.9, and a current density of about 50 A/ft$^2$ (54 mA/cm$^2$). For comparison, a second substrate was coated with a matte finish from a standard Watts nickel bath. The Ni/P test specimen was subjected to accelerated oxidation at 50° C. and 95% R.H. for 125 days, while the Watts Ni sample was subjected to the same environment for just 96 hours. FIG. 3 shows cumulative probability plots for the contact resistance of both test samples, measured as described for Example III above. The results show a contact resistance of less than 5 mΩ at the 99th percentile for the Ni/P sample, but a corresponding 99th percentile level of well over 100 mΩ for the Watts Ni sample, which was only exposed for 96 hours.

EXAMPLE VI

Figure 4:
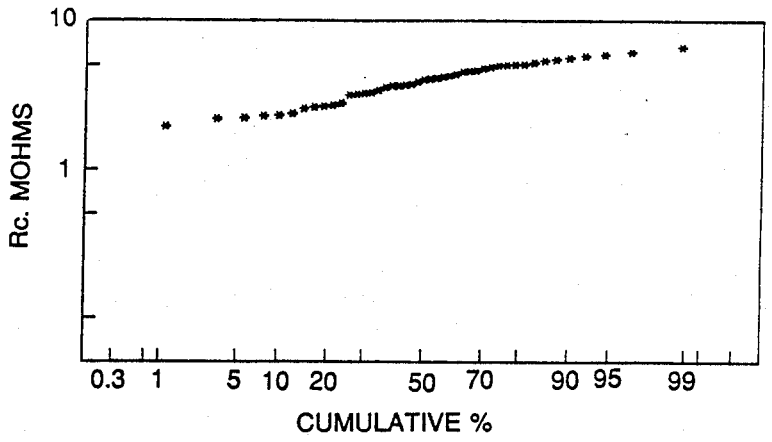
FIG. 4 depicts the results of an accelerated oxidation test on an Ni/Co-plated specimen, made in accordance with the present invention.

An Ni/Co plated sample was prepared using the composition of the above Bath #4, at a temperature of about 55° C., a pH of about 8.0, and a current density of about 70 A/ft$^2$ (75 mA/cm$^2$). As with the above examples, the Ni/Co test specimen was subjected to accelerated oxidation at 50° C. and 95% R.H. for 125 days. FIG. 4 shows the cumulative probability plot of contact resistance for this sample, measured as described for Example III above. The results show a contact resistance of less than 10 mΩ at the 99th percentile.

EXAMPLE VII

Ni/P test samples, plated by the methods of the above examples, were tested for wear resistance along with a typical cobalt-hardened gold plated comparison sample. Wear resistance was evaluated using a crossed-wire wear test method to simulate the wear that develops on wiping-type connectors. (For details of this test method, see Holden, C. A., "Wear Study of Electroplated Coatings for Contacts", *Proceedings of the Engineering Seminar on Electrical Contact Phenomena,* IIT Research Institute, Nov. 6–9, 1967, pp 1–20, incorporated herein by reference.) This wear testing method has been used to evaluate gold plating on similar connectors. Two plated wires (2 mm diameter) were mounted on an apparatus with their axes at right angles. The top wire was held rigid while the bottom wire was moved back and forth at a 45° angle so that any wear products were pushed to the sides of the wear track instead of piling up at the ends. A load of 200 g was set by applying pressure to the lower wire through a balanced beam arrangement. Before testing, the wires were lubricated with an organic lubricant. Connectors, even those made with hardened gold, generally require some sort of lubrication during initial wear-in. The wear resistance of the Ni/P samples was as good as that of the hard gold specimen through 2000 wear test cycles.

Wear resistance tests were also conducted on Ni/P samples coated with a thin flash of gold, as in Example IV. The relatively thin layer of soft gold, was found to act as a lubricant in the initial wear-in, and therefore did not require the organic lubricant. As above, wear resistance was as good as that of the hardened gold specimen through 2000 test cycles.

EXAMPLE VIII

Figure 5:
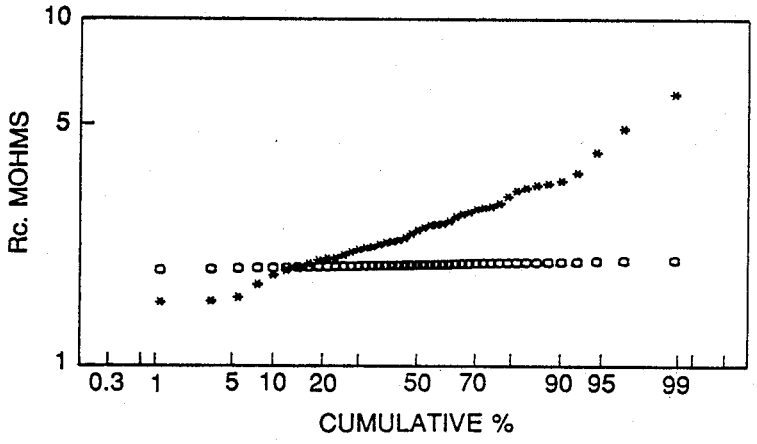
FIG. 5 depicts the results of contact resistance tests performed on an Ni/P-plated specimen, made in accordance with the present invention, and a gold-plated comparative sample, after both were exposed to a contaminating environment.

As previously discussed, it is important for ZIF-type connectors to make good low-resistance connections even when the contact surfaces have been exposed to a contaminated environment. An Ni/P-plated test specimen was prepared using the composition of above Bath #3, under the same conditions as Example V. A comparative specimen was prepared by plating a copper substrate with standard cobalt-hardened gold. Both test specimens were then exposed to ambient laboratory air at 23° C. for a period of two months. Contact resistance tests were then conducted as in Example III above, and the results are shown in FIG. 5. These tests show that the average contact resistance of the gold-plated sample (Au) increased after exposure to the laboratory environment, while the Ni/P sample continued to have good, low contact resistance. It is believed that the surfaces of both specimens were contaminated by the impurities in the laboratory air, but that the Ni/P surface, with its microscopic asperities, was more tolerant of this contamination.

For comparison, samples were made of matte finish surfaces prepared in accordance with the disclosure of U.S. Pat. No. 4,564,565, which was previously discussed. The samples were made as described in the patent using $TiF_6$ and $ZrF_6$ additives. Using $TiF_6$, the hardest coating which could be made had a hardness of about 285 HK. This was achieved by using a current density in excess of 140 mA/cm$^2$. At current densities below 140 mA/cm$^2$, the hardness were all below 215 HK. For the $ZrF_6$ containing samples, the best hardness, at greater than 140 mA/cm$^2$, was about 265 HK. At lower current densities, the hardness values were all below 245 HK. None of these samples met the criteria of the present invention which calls for a hardness of greater than 300 HK.

The above examples utilized hardened nickel as the coating material. However, any metal which provides a hard matte finish in accordance with the requirements of this invention is suitable. For example, cobalt is another non-precious metal which is suitable for forming matte-finish coatings. Matte-finish coatings were also prepared from palladium, and compared favorably to bright-finish palladium coatings.

The terms and expressions which have been employed are used as terms of description and not of limitation, and there is not intention, in the use of such terms and expressions, of excluding any equivalents of the features shown and described or portions thereof, but it is recognized that various modifications are possible within the scope of the invention claimed.

We claim:

1. An electrical device with contacts, in which said contacts comprise a conductive region, characterized in that:

said region comprises a conductive matte-finish surface with a Knoop hardness number of at least 300, a diffuse reflectance of less than about 20 percent, and a specular reflectance of less than about 2 percent; and said conductive region has a contact resistance of less than about 50 milliohms, under a 50-gram load, after exposure to 50° C. and 95% relative humidity for a period of 20 days.

2. The device of claim 1 further characterized in that said matte-finish surface comprises asperities having an average of included peak angles of less than about 90 degrees.

3. The device of claim 1 further characterized in that said conductive region further comprises a gold layer on top of said matte-finish surface.

4. The device of claim 3 further characterized in that said gold layer is between about 0.025 and 0.6 micrometers thick.

5. The device of claim 1 further characterized in that said conductive region comprises a hardened nickel.

6. The device of claim 5 further characterized in that said hardened nickel is a nickel/cobalt material containing at least 0.01 atomic percent cobalt.

7. The device of claim 5 further characterized in that said hardened nickel is a nickel/phosphorus material containing at least 0.01 atomic percent phosphorus.

8. The device of claim 7 further characterized in that said nickel/phosphorus material contains between 0.1 and 0.5 atomic percent phosphorus.

9. The device of claim 5 further characterized in that said contacts are formed by a process comprising:

a. providing a plating bath including a soluble nickel ion salt, a soluble source of an available nickel-hardening element, and means to maintain the nickel ion in solution;

b. maintaining the pH of the bath at a level above about 7.0; and c. forming said conductive region by electroplating a conductive substrate as a cathode in said bath.

10. The device of claim 9 further characterized in that the nickel-hardening element provided is cobalt.

11. The device of claim 9 further characterized in that said means to maintain said nickel ion in solution is a complexing agent comprising one or more soluble ammonium salts.

12. The device of claim 9 further characterized in that the pH of the bath is maintained at a level between about 7.7 and 8.3.

13. The device of claim 9 further characterized in that said step of maintaining the pH of the bath comprises adding ammonium hydroxide to the bath.

14. The device of claim 9 further characterized in that the nickel-hardening element provided is phosphorus.

15. The device of claim 14 further characterized in that the provided soluble source of available phosphorus is a phosphorous or hypophosphorous acid or salt.

16. The device of claim 15 further characterized in that the provided soluble source of available phosphorus is phosphorous acid.

* * * * *